US006835052B2

(12) United States Patent
Kim

(10) Patent No.: US 6,835,052 B2
(45) Date of Patent: Dec. 28, 2004

(54) SUCTION VALVE ASSEMBLY OF RECIPROCATING COMPRESSOR

(75) Inventor: Hyung-Jin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 14 days.

(21) Appl. No.: 10/321,476

(22) Filed: Dec. 18, 2002

(65) Prior Publication Data

US 2003/0165391 A1 Sep. 4, 2003

(30) Foreign Application Priority Data

Jan. 3, 2002 (KR) ..... 2002/228

(51) Int. Cl.[7] ..... F04B 53/12
(52) U.S. Cl. ..... 417/552
(58) Field of Search ..... 417/552, 545, 417/417, 555.1, 547, 553; 91/422; 137/533.31

(56) References Cited

U.S. PATENT DOCUMENTS 307,862 A * 11/1884 Loth ..... 417/552
5,947,708 A * 9/1999 Park et al. ..... 417/552
6,398,523 B1 * 6/2002 Hur et al. ..... 417/417
6,666,663 B2 * 12/2003 Lee et al. ..... 417/417

* cited by examiner

*Primary Examiner*—Michael Koczo
(74) *Attorney, Agent, or Firm*—Greenblum & Bernstein, P.L.C.

(57) ABSTRACT

A suction valve assembly of a reciprocating compressor includes: an inertial valve having a valve plate detachably attached at a valve seat of a piston, and opening and shutting the suction passage, and a support bar extended from a rear side of the valve plate, inserted into the suction passage and a plurality of guide grooves at regular intervals in a circumferential direction thereof; and guide pins slidably inserted into the guide grooves of the inertial valve and fixed at the piston to limit an opening rate of the valve plate, thereby minimizing a dead volume inside a compression chamber by making a valve side forming the compression chamber to be plane and strengthening a structural coupling strength of a valve.

8 Claims, 5 Drawing Sheets

SUCTION VALVE ASSEMBLY OF RECIPROCATING COMPRESSOR

BACKGROUND OF THE INVENTION

1. Field of the Invention

The present invention relates to a suction valve assembly of a reciprocating compressor, and more particularly, to a suction valve assembly of a reciprocating compressor that is capable of preventing occurrence of dead volume inside a compression chamber and capable of improving an operation reliability of the reciprocating compressor.

2. Description of the Background Art

In general, a suction valve assembly is installed between a compression chamber for compressing a fluid and a suction passage for sucking the fluid in a reciprocating compressor, so as to be opened owing to an inertia when the fluid is sucked to supply the fluid introduced through the suction passage to the compression chamber and prevent the fluid compressed in the compression chamber from flowing backward.

FIG. 1 is a partial sectional view of a compressor having a suction valve assembly in accordance with a conventional art, FIG. 2 is an exploded perspective view of the suction valve in accordance with the conventional art, and FIG. 3 is a front view of the suction valve in accordance with the conventional art.

The conventional compressor includes a cylinder 104 fixedly disposed at a case (not shown) and forming a compression chamber 102; a piston 106 for being linearly, reciprocally and movably inserted in the cylinder 104 and compressing a fluid; a suction valve 110 mounted at a front side of the piston 106 and opening and shutting the fluid being sucked; and a discharge valve assembly 108 for discharging the fluid from the compression chamber 102 when the fluid is compressed by higher than a certain level in the compression chamber 102.

The piston 106 includes a suction passage 112 for sucking the fluid in a longitudinal direction at the central portion thereof, a suction hole 114 formed at the front side of the piston 106 for supplying the fluid introduced into the suction passage 112 into the compression chamber 102, and a suction valve 110 mounted at the front side of the suction hole 114 for opening and shutting the suction hole 114.

One side of the suction valve 110 is fixed by a bolt or welded at the front side of the piston 106 and formed as a disk type having a certain elastic force.

The suction valve 110 includes a fixing portion 120 of which the center is fixed by a bolt or welded at the center of the front side of the piston 106, a slit 122 cut in a curved line with a certain width, and an open and shut portion 126 formed at one side of the suction valve 110 divided by the slit 122 and cantacted to the suction hole 112.

The open and shut portion 126 has a certain elastic force when it becomes open from a neck portion 124 of the slit 122.

The discharge valve assembly 108 includes a valve cover 132 mounted at a front side of the cylinder 104 and having a discharge hole 130 for discharging a fluid, a discharge valve 134 contacted at the front side of the cylinder 104 and making an opening and shutting operation of fluid, and a spring 136 arranged between the discharge valve 134 and an inner wall of the valve cover 132 and giving a certain elastic force to the discharge valve 134.

In the suction valve of the reciprocating compressor in accordance with the conventional art, when the piston 106 is retreated by an operation of a driving device (not shown) of the compressor so as to supply a fluid to the compression chamber 102, the open and shut portion 126 of the suction valve 110 is separated down from the front side of the piston 106 owing to the pressure of the fluid to open the suction hole 114, so that the fluid introduced into the suction passage 112 is supplied to the compression chamber 102.

In this state, when the piston 106 is advanced to compress the fluid, the suction valve 126 is contacted at the front side of the piston 106 owing to the elastic force by itself to shut the suction hole 114, and when the piston 106 is more advanced therefrom, the elastic force of the spring 136 is overcome, thereby the discharge valve 136 is separated from the front side of the cylinder 104, and the fluid compressed in the compression chamber 102 is discharged outwardly through the discharge hole 130.

However, the suction valve of the reciprocating compressor in accordance with the conventional art has the thin flat disk type and one side thereof is cut and bent centering around the neck portion, whereby the open and shut portion is bent to open and shut the suction hole. Thus, when the open and shut portion is separated from the front side of the piston, a stress works concentratively on the neck portion. Therefore, if the open and shut portion is continuously opened and shut or excessively opened, the neck portion can be damaged.

In addition, with these problems, if the compressor has a large capacity, when a fluid compression volume is designed large, the area in which the open and shut portion is opened is limited, degrading an efficiency of the compressor.

Moreover, as described above, the suction valve is coupled to the front side of the piston by welding or by bolt. Thus, in case of fixing with the bolt, a dead volume occurs inside the compression chamber. Meanwhile, in case of welding, a high pressure is generated so that the fixing portion of the suction valve is separated from the front side of the piston.

SUMMARY OF THE INVENTION

Therefore, an object of the present invention is to provide a suction valve assembly of a reciprocating compressor that is capable of minimizing a dead volume inside a compression chamber by making a valve side forming the compression chamber to be plane.

Another object of the present invention is to provide a suction valve assembly of a reciprocating compressor that is capable of strengthening a structural coupling strength of a valve and capable of improving an operation reliability.

To achieve these and other advantages and in accordance with the purpose of the present invention, as embodied and broadly described herein, there is provided a suction valve assembly of a reciprocating compressor including: a piston 6 disposed to be linearly movable at a cylinder 4 forming a compression chamber 2 and having a suction passage 8 for sucking a fluid and a valve 14 formed at a front side thereof; a valve plate 20 detachably attached at the valve seat 14 of the piston 6, and opening and shutting the suction passage 8; an inertial valve 16 extended from a rear side of the valve plate 20 and inserted into the suction passage 8 and having a support bar 22 with a plurality of guide grooves 24 at regular intervals in a circumferential direction; and a guide pin 18 slidably inserted into the guide groove 24 of the inertial valve and fixed at the piston 6 to limit an opening rate of the valve plate 20.

In the suction valve assembly of a reciprocating compressor of the present invention, the inertial valve 16 includes a plurality of valve guides 26 being radially extended from an outer circumferential face of the support bar 22 so as to be in contact with an inner wall of the piston 6 to support movement of the inertial valve, one side thereof being attached to a rear side of the valve plate 20 so as to reinforce the valve plate.

In the suction valve assembly of a reciprocating compressor of the present invention, the valve guide 26 is extended at the interval of 1200 from the outer circumferential surface of the support bar 22.

In the suction valve assembly of a reciprocating compressor of the present invention, the valve plate 20 is formed as a disk type, having a diameter larger than an inner diameter of the piston 6 and smaller than an inner diameter of the cylinder 4.

In the suction valve assembly of a reciprocating compressor of the present invention, the valve seat 14 is formed flat and the valve plate 20 is also formed flat, so that both even surfaces are in contact with each other.

In the suction valve assembly of a reciprocating compressor of the present invention, the valve plate 20 includes an inner surface with a certain slope angle and the valve seat 14 also includes a marginal portion with the same slope angle, so that both sloped surfaces are in contact with each other.

In the suction valve assembly of a reciprocating compressor of the present invention, the guide grooves 24 are formed with a certain length in an axial direction of the support bar 22 at intervals of 120° in a circumferential direction of the support bar 22.

In the suction valve assembly of a reciprocating compressor of the present invention, one side of the guide pin 18 is fixed to a press-fit groove 30 which is formed at regular intervals in a circumferential direction of the piston 6, and the other side of the guide pin 18 is slidably inserted into each guide groove 24 and moved along the guide groove 24.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may exist a plurality of embodiments of a suction valve of a compressor in accordance with the present invention, of which the most preferred one will now be described.

Figure 1:
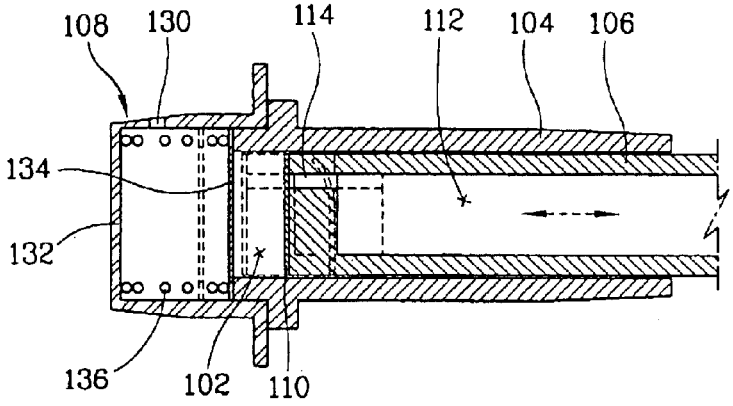
FIG. 1 BACKGROUND ART
FIG. 1 is a partial sectional view of a compressor having a suction valve in accordance with a conventional art.
Figure 2:
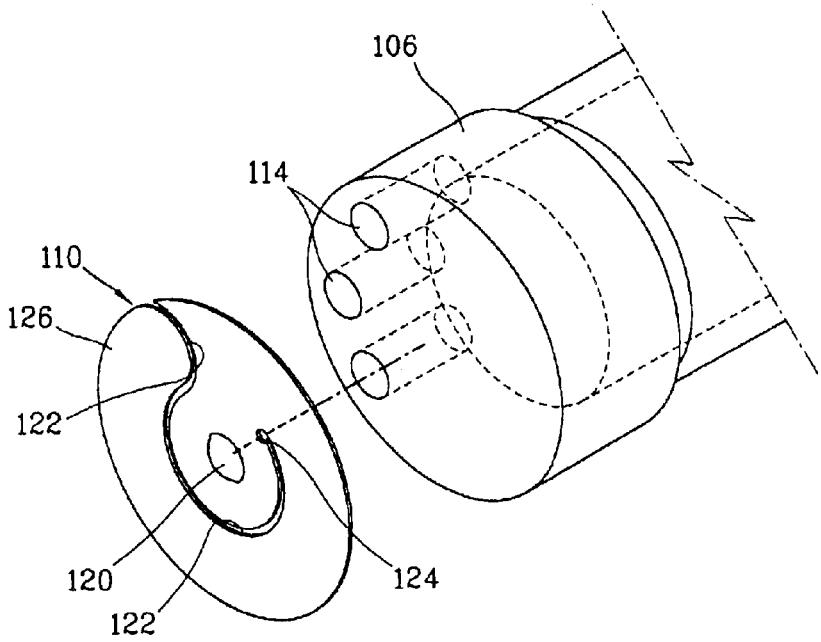
FIG. 2 BACKGROUND ART
FIG. 2 is an exploded perspective view of the suction valve in accordance with the conventional art.
Figure 3:
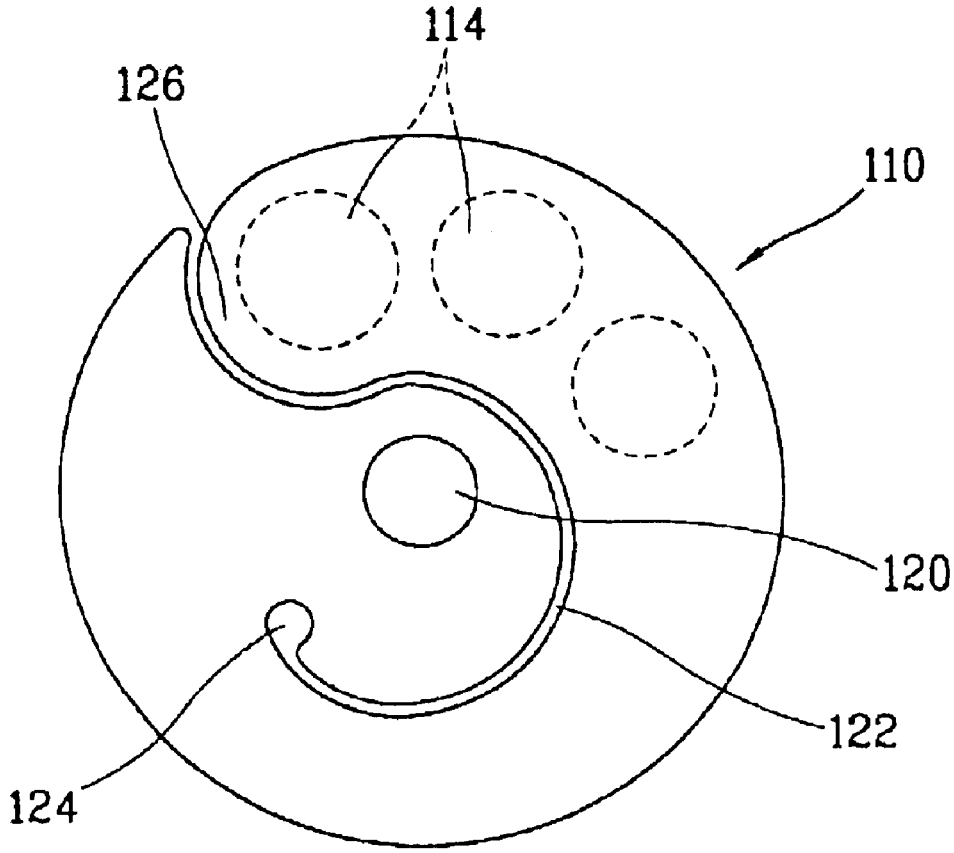
FIG. 3 BACKGROUND ART
FIG. 3 is a front view of the suction valve in accordance with the conventional art.
Figure 4:
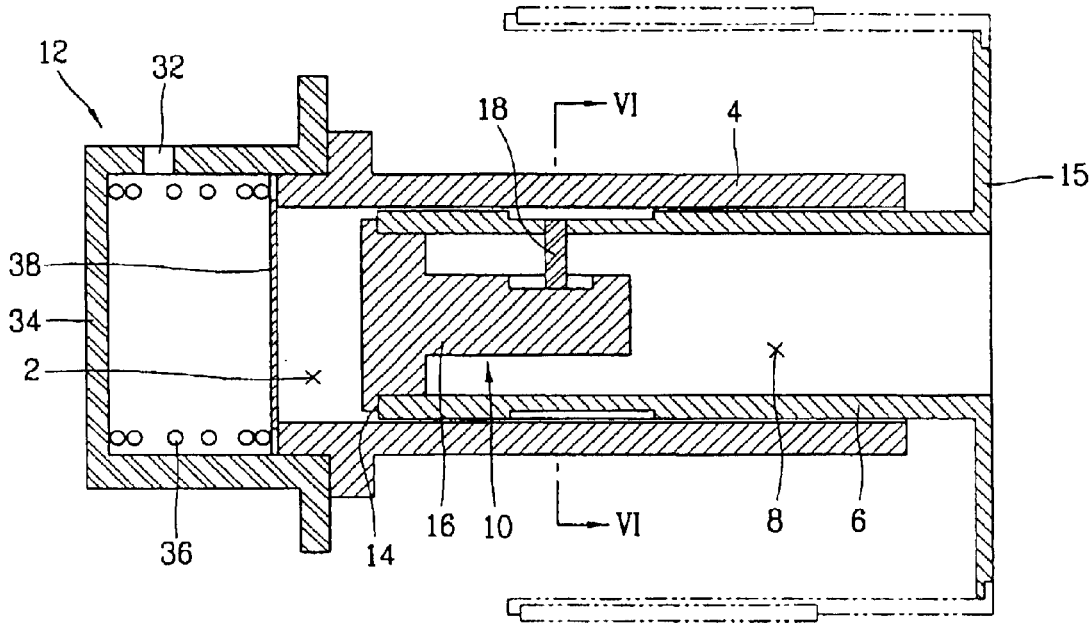
FIG. 4 is a partial sectional view of a compressor having a suction valve assembly in accordance with one embodiment of the present invention.

FIG. 4 is a partial sectional view of a compressor having a suction valve assembly in accordance with one embodiment of the present invention.

The compressor of the present invention includes: a cylinder 4 fixed at a compressor case (not shown) and forming a compression chamber 2; a piston 6 disposed linearly movable inside the cylinder 4, compressing a fluid and forming a suction passage 8; a suction valve assembly 10 installed at a front side of the piston 6, supplying a fluid to a compression chamber 2 when the piston is retreated, and preventing the fluid inside the compression chamber 2 from flowing back when the piston 6 is advanced; and a discharge valve assembly 12 mounted at a front side of the cylinder 4 and discharging the fluid when a compression pressure is above a predetermined value.

The piston 6 includes the suction passage 8 for sucking a fluid formed at the inner circumferential face thereof in a longitudinal direction, a valve seat 14 formed at the front side thereof so as to contact the suction valve assembly, and a piston flange 15 formed at a rear side thereof, being connected to a driving device(not shown).

The suction valve assembly 10 includes an inertial valve 16 inserted to be linearly movable to the front side of the piston 6 and contacted to the valve seat 14 of the piston to open and shut the suction passage 8, and a guide pin 18 connected between the inertial valve 16 and the piston 6 and preventing the inertial valve 16 from releasing from the piston 6.

Figure 5:
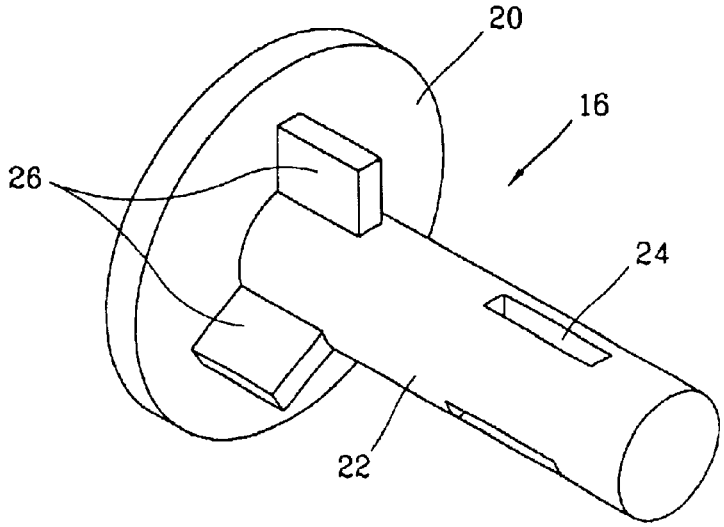
FIG. 5 is a perspective view of an inertial valve of the suction valve assembly in accordance with the present invention.

As shown in FIG. 5, the inertial valve 16 includes a valve plate 20 contacted to or separated from the valve seat 14 to shut or open the suction passage 8, a support bar 22 extended with a certain length from the center of the valve plate 20 and having a diameter smaller than that of the suction passage 8, and a valve guides 26 radially extended from an outer circumferential face of the support bar 22 and being in contact with an inner circumferential face of the piston 6 so as to support a linear movement of the inertial valve 16. A guide grooves 24 are formed at the support bar 22, into which the guide pins 18 are inserted and slid.

The valve plate 20 is formed as a disk type with a diameter greater than an inner diameter of the piston 6 and smaller than an inner diameter of the cylinder 4. A rear side of the valve plate 20 is contacted to and separated from the valve seat 14 so as to shut and open the suction passage 8, and a front side thereof forms a portion of the compression chamber 2.

One side of the valve guides 26 are in attached with a rear side of the valve plate 20 and radially extended at regular intervals from the outer circumferential face of the support bar 22 so that an outer side of the valve guides 26 are in contact with the inner circumferential face of the piston 6 to support a linear movement of the inertial valve 16 and reinforce the valve plate 20.

Preferably, there are formed three valve guides 26 integrally extended with intervals of 120° from the outer circumferential face of the support bar 22.

A plurality of guide grooves 24 are formed at regular intervals in the circumferential direction of the support bar 22 and has such a certain length as to suitably maintain an opening rate of the inertial valve 20 in an axial direction of the support bar 22.

Figure 6:
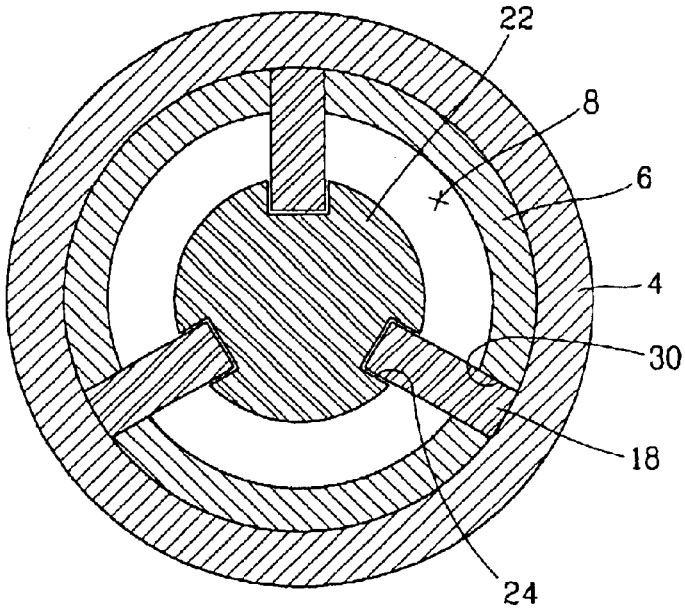
FIG. 6 is a sectional view taking along line VI-VI of FIG. 4.

As shown in FIG. 6, one ends of the guide pins 18 are, respectively, fixed in the press-fit holes 30 formed at regular intervals in a circumferential direction of the piston 6, and the other ends thereof are slidably inserted into the guide grooves 24 so as to limit an opening rate of the inertial valve 16.

Preferably, there are formed three guide grooves 24 at intervals of 120° in the circumferential direction of the support bar, and accordingly, there are also formed three guide pins 18.

The discharge valve assembly 12 includes a valve cover 34 mounted at a front side of the cylinder 4 and having a discharge hole 32 for discharging a fluid formed at one side thereof, a discharge valve 38 inserted in the valve cover 34 and tightly contacted to the front side of the cylinder to form one portion of the compression chamber 2, and a valve spring 36 inserted between one side of the discharge valve 38 and an inner wall of the valve cover 34 and giving a certain elastic force to the discharge valve 38.

That is, in the discharge valve assembly 12, when the pressure of the compression chamber 2 is above a predetermined level, the discharge valve 38 overcomes the elastic force of the valve spring 38 and is retreated, so that the fluid compressed in the compression chamber 2 is discharged outwardly through the discharge hole 32.

Figure 7:
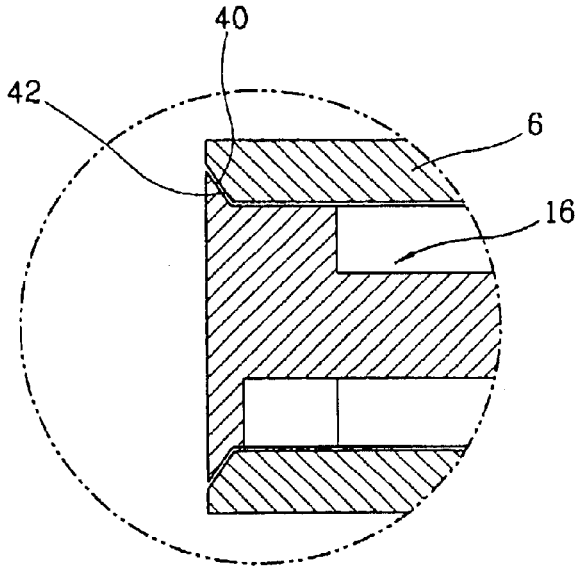
FIG. 7 is a partial sectional view of a suction valve assembly in accordance with another embodiment of the present invention.

FIG. 7 is a partial sectional view of a suction valve assembly in accordance with another embodiment of the present invention.

As shown in FIG. 7, it has the same structure as that of the suction valve assembly in the former embodiment, except for a change in the structure of the valve plate and the valve seat of the piston.

Namely, the valve plate 40 in accordance with another embodiment of the present invention is formed as a corn type such that its marginal portion has a certain sloped angle, and the valve seat 42 has a sloped side with such a slope angle of the valve seat 40.

In this respect, preferably, a contact area between the valve seat 42 and the valve plate 40 is formed as small as possible in order to prevent a delay in opening a valve by the fluid.

The operation of the suction valve assembly of a reciprocating compressor constructed as described above will now be described.

Figure 8:
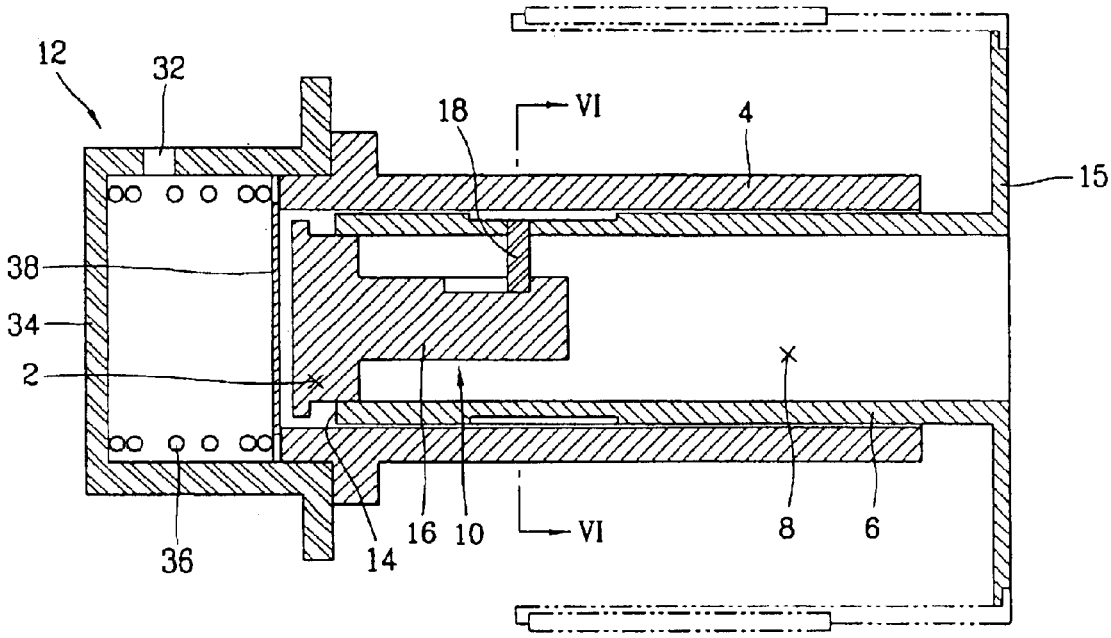
FIG. 8 is a view showing an operation state of the suction valve assembly in accordance with the present invention.

FIG. 8 is a view showing an operation state of the suction valve assembly in accordance with the present invention.

First, when a driving force of the driving device (not shown) is transferred to the piston 6 by a piston flange 15, the piston 6 is retreated and the inertial valve 16 is moved forward owing to the pressure difference of the fluid and the piston retreating inertia, and accordingly, the valve plate 20 is separated from the valve seat 14 of the piston to open the suction passage 8, so that the fluid introduced into the suction passage 8 is supplied to the compression chamber 2.

At this time, the inertial valve 16 is hooked by the guide pins 18, so that its opening rate is limited. That is, when the inertial valve 16 is moved forward, the guide pins 18 fixed at the piston 6 are moved along the guide grooves 24, and at the time point where the opening rate of the valve plate 20 is the maximum, the guide pins 18 are hooked at the end portion of the guide grooves 24, thereby limiting the opening rate of the valve plate 20.

In this state, the driving mechanism is driven backward and the piston 6 is advanced to apply a pressure to the fluid filled in the compression chamber 2, and when the pressure in the compression chamber 2 goes beyond a certain level, the discharge valve 38, overcoming the elastic force of the valve spring 36, is retreated from the front side of the cylinder 4. Then, the fluid compressed in the compression chamber 2 is outwardly discharged through the discharge hole 32 formed at the valve cover 34.

At this time, as the inertial valve 16 is retreated owing to the pressure in the compression chamber 2, the valve plate 20 is tightly contacted to the valve seat 14 of the piston 6, whereby the fluid filled in the compression chamber 2 is prevented from flowing back to the suction passage 8.

In this case, when the inertial valve 16 is advanced or retreated, since the valve guides 26 guides the inertial valve 16 by being slid along the inner wall face of the piston 6, occurrence of a tilting moment of the inertial valve is prevented and the inertial valve 16 can be accurately advanced and retreated. In addition, since one side of the valve guides 26 are integrally formed at the lower surface of the valve plate 20, the rigidity of the valve plate 20 can be reinforced.

As so far described, the suction valve assembly of a reciprocating compressor of the present invention have the following advantages.

That is, since the front surface of the valve plate of the inertial valve attached to the valve seat of the piston is formed flat, a dead volume inside the compression chamber can be minimized.

In addition, since the valve guides are formed at the outer circumferential face of the support bar of the inertial valve, the inertial valve can be supported in its movement, so that a tilting moment can be prevented from occurring. Also, since the valve guides are attached at the rear surface of the valve plate, it can serve to reinforce the valve plate.

Furthermore, since the plurality of guide pins are inserted at regular intervals at the outer circumferential face of the support bar, they can endure an impact caused when the inertial valve is opened and shut, so that the valve can be prevented from damaging.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A suction valve assembly of a reciprocating compressor comprising:

a piston disposed to be linearly movable in a cylinder forming a compression chamber and having a suction passage for sucking a fluid and a valve seat formed at a front side thereof;

an inertial valve having a valve plate detachably attached at the valve seat of the piston and opening and shutting the suction passage, the inertial valve having a support bar extended from a rear side of the valve plate and inserted into the suction passage, the support bar having a plurality of guide grooves at regular intervals in a circumferential direction thereof; and a plurality of guide pins slidably inserted into the plurality of guide grooves of the support bar of the inertial valve, the plurality of guide pins being fixed at the piston to limit an opening rate of the valve plate.

2. The assembly of claim 1, wherein the inertial valve includes a plurality of valve guides being radially extended from an outer circumferential face of the support bar so as to be in contact with an inner wall of the piston to support movement of the inertial valve, one side thereof being attached to a rear side of the valve plate so as to reinforce the valve plate.

3. The assembly of claim 2, wherein the valve guides are formed at the interval of 120° from the outer circumferential surface of the support bar.

4. The assembly of claim 1, wherein the valve plate is formed as a disk type, having a diameter larger than an inner diameter of the piston and smaller than an inner diameter of the cylinder.

5. The assembly of claim 1, wherein the valve seat is formed flat and the valve plate is also formed flat, so that both even surfaces are in contact with each other.

6. The assembly of claim 1, wherein the valve plate includes a marginal portion with a certain slope angle and the valve seat also includes an inner surface with the same slope angle, so that both sloped surfaces are in contact with each other.

7. The assembly of claim 1, wherein the plurality of guide grooves are formed with a certain length in an axial direction of the support bar at intervals of 120° in a circumferential direction of the support bar.

8. The assembly of claim 1, wherein one side of the guide pins are fixed to press-fit grooves which is formed at regular intervals in a circumferential direction of the piston, and the other side of the guide pins are slidably inserted into each guide grooves and moved along the guide grooves.

* * * * *